US007237499B2

(12) United States Patent
Armstrong et al.

(10) Patent No.: US 7,237,499 B2
(45) Date of Patent: Jul. 3, 2007

(54) SUPPORT STRUCTURE

(75) Inventors: Neville A. Armstrong, Coogee, WA (US); Wayne Murray, Canning Vale, WA (US)

(73) Assignee: Austal Ships Pty Ltd, Henderson (AU)

( * ) Notice: Subject to any disclaimer, the term of this patent is extended or adjusted under 35 U.S.C. 154(b) by 0 days.

(21) Appl. No.: 11/225,846

(22) Filed: Sep. 14, 2005

(65) Prior Publication Data

US 2006/0243181 A1 Nov. 2, 2006

(30) Foreign Application Priority Data

Sep. 15, 2004 (AU) ..... 2004905331

(51) Int. Cl.
*B63B 3/00* (2006.01)

(52) U.S. Cl. ..... 114/65 R; 440/111

(58) Field of Classification Search ..... 114/65 R; 440/111; 248/562, 566, 659, 671
See application file for complete search history.

(56) References Cited

U.S. PATENT DOCUMENTS

| | | | | |
|---|---|---|---|---|
| 4,678,439 | A * | 7/1987 | Schlichthorst | 440/111 |
| 4,747,360 | A * | 5/1988 | Tuncel et al. | 440/111 |
| 4,778,421 | A * | 10/1988 | Greenberg | 440/111 |
| 5,211,592 | A * | 5/1993 | Alkema | 440/111 |
| 5,509,837 | A * | 4/1996 | Allbright et al. | 440/111 |
| 6,623,318 | B1 * | 9/2003 | Kantola | 440/111 |

* cited by examiner

*Primary Examiner*—Lars A. Olson
(74) *Attorney, Agent, or Firm*—Stites & Harbison PLLC; Ross F. Hunt, Jr.

(57) ABSTRACT

A support structure for auxiliary machinery in a seagoing vessel, the support structure comprising a trussed frame supporting a mounting plate at an elevated height above the bottom or deck of the vessel, the mounting plate being adapted to support auxiliary machinery, the trussed frame comprising beams arranged in triangles along the sides and ends of the frame, whereby the frame elevates the machinery and provides ready access to the underside of the machinery.

6 Claims, 4 Drawing Sheets

M
H
W1
F
F
G1
G2
WC
W1
W2
H
H
V
P 20
20
22
24
11
21
23
10
18
17
18
17
17
13
17
14
12
17
18
18
D
19
Y

SUPPORT STRUCTURE

INTRODUCTION

This invention relates to a support structure for use with auxiliary machinery in a sea going vessel. More particularly the invention relates to a support structure to support auxiliary machinery used in a multi hulled passenger and vehicle carrying sea going vessel.

BACKGROUND OF THE INVENTION

Sea going vessels are usually propelled by large diesel engines that are housed within the hull of the vessel to drive one or more propulsion systems at the stern of the vessel via drive shafts that are located in housings that extend from the engine or engines. Such vessels also have a requirement for auxiliary machinery, that is machinery that is driven off the internal combustion engines or turbines to power generators, pumps and a variety of other componentry that is conventional in vessels of this kind.

Because this auxiliary machinery is driven by, for example, diesel engines and there is a considerable transfer of force from the diesel engines to the auxiliary machinery and this force requires a substantial support structure there is a need for means to reduce or eliminate vibration which is highly undesirable as it can resonate through the hull of the vessel. One means of reducing vibration is to further increase the size of the support structure and this can be a particular problem where the ship is constructed of aluminum in order to obtain light weight. The support structure that is thus used to support auxiliary machinery usually limits access to the machinery especially access to the machinery services that are frequently located on the underside of the machinery such as electrical cabling, cooling water and fuel supplies. Furthermore, access to the mounting bolts and the machines themselves can be difficult because of the substantial nature of the support structure.

On high speed light weight craft engine rooms are usually congested because the need for high speed results in very large power units and thus physically large engines and associated transmission systems. In multi hulled vessels this is a particular problem due to the narrowness of the hulls and yet the need for an engine room that can house a power unit of substantial size.

It is these issues that have brought about the present invention.

SUMMARY OF THE INVENTION

According to the present invention there is provided a support structure for auxiliary machinery of a sea going vessel, the support structure comprising a trussed frame supporting a mounting plate at an elevated height above the bottom or deck of the vessel, the mounting plate being adapted to support auxiliary machinery, the trussed frame comprising beams arranged in triangles along the sides and ends of the frame, whereby the frame elevates the machinery and provides ready access to the underside of the machinery.

Preferably the beams are constructed in aluminum.

Preferably the beams have a rectangular or square cross section. Alternatively the beams may be of circular or similar cross section.

In another embodiment a diagonal bracing beam is removed from either end of the frame to make way for a girder joining the plate or frame to the frame of the vessel on each side of the vessel.

Vibrational damping mounts may be positioned between the frame and the plate or at the joins between the beams of the truss.

DESCRIPTION OF THE DRAWINGS

The prior art and an embodiment of this invention will now be described by way of example only with reference to the accompanying drawings in which.

DESCRIPTION OF THE PREFERRED EMBODIMENT

Figure 1:
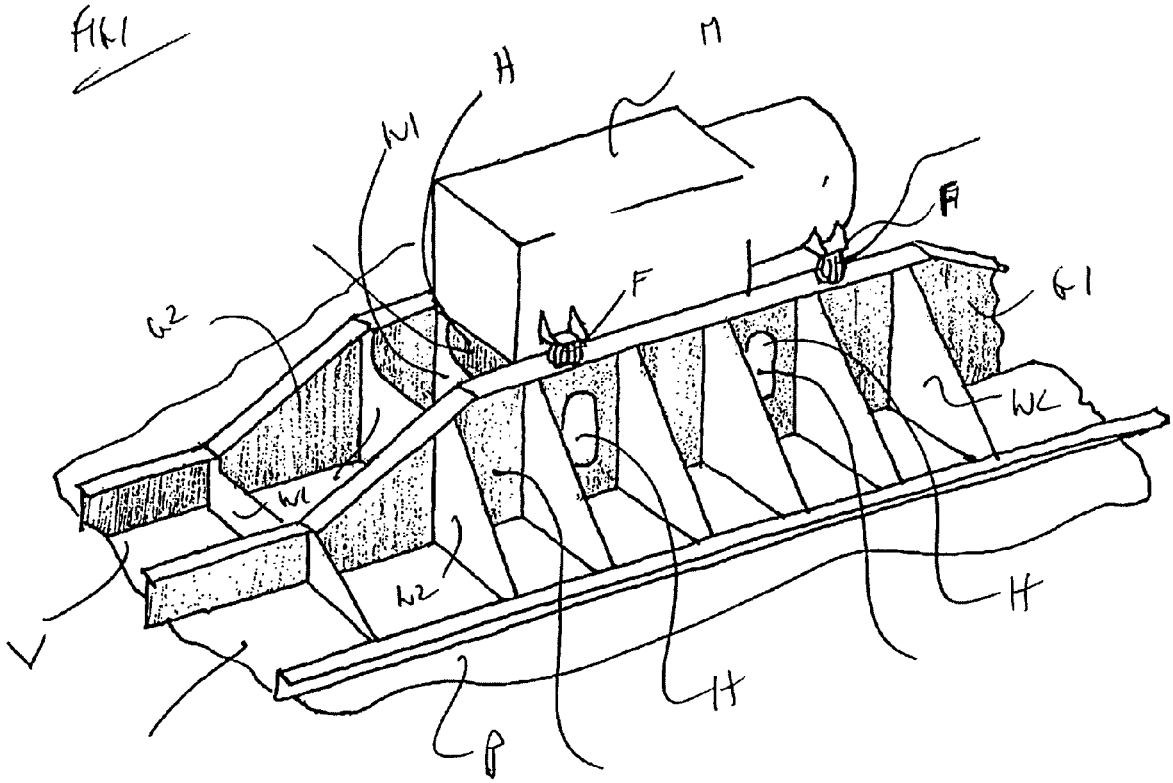
FIG. 1 is a perspective view of a typical conventional installation of auxiliary machinery.
Figure 2:
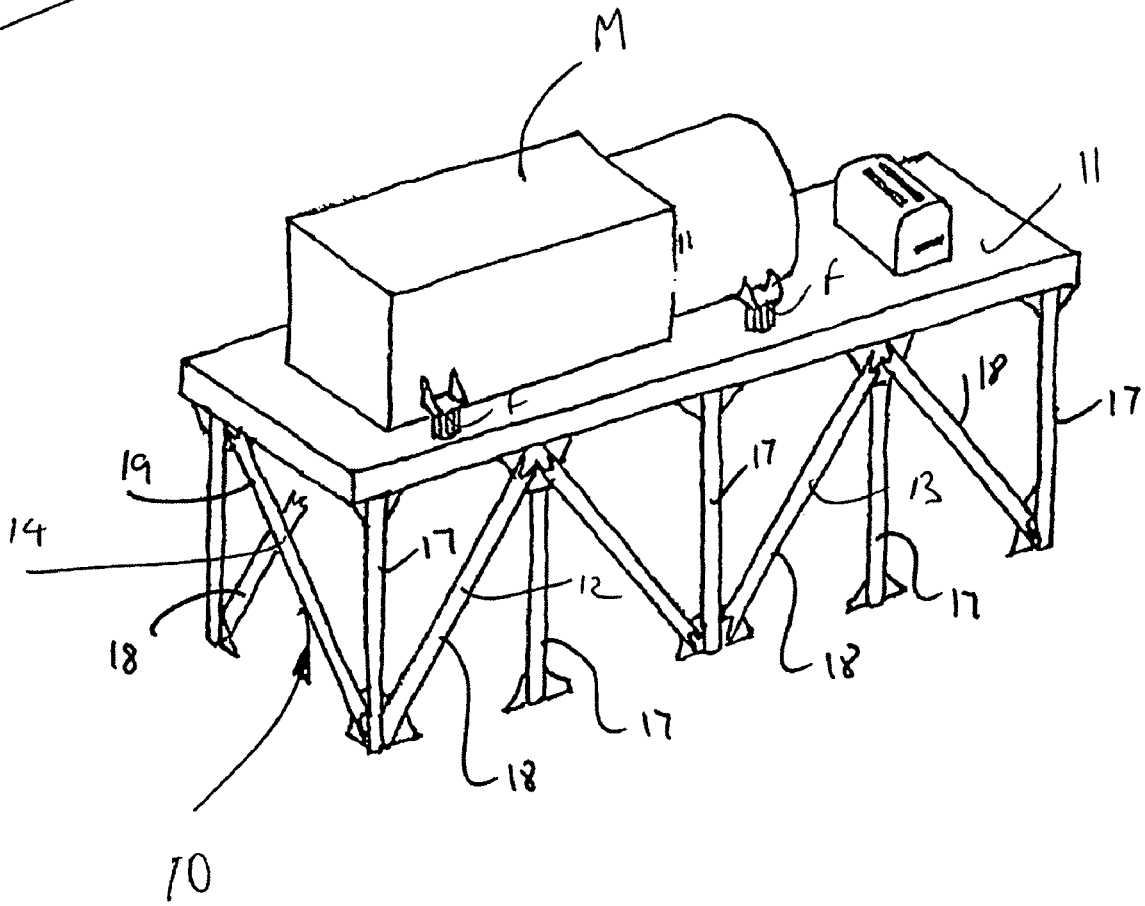
FIG. 2 is a perspective view of an installation of auxiliary machinery in accordance with an embodiment of this invention.

A conventional installation of auxiliary machinery M is shown in FIG. 1 in which the auxiliary machinery M is supported in an elevated configuration by a pair of spaced girders G1 and G2 via flexible mounts F positioned at each corner of the machinery. The auxiliary machinery M spans the two girders which are welded to project in a parallel array upwardly from the bottom plating P of the vessel V. A series of interconnecting webs W join the girders G1 and G2 and lateral support webs W2 extend from the sides of the girders to the plating P. A series of access holes H are provided along the girders and the webs to provide access to the underside of the auxiliary machinery M. However this is a cumbersome arrangement with very difficult and limited access that has proved unsatisfactory in practice.

Figure 3:
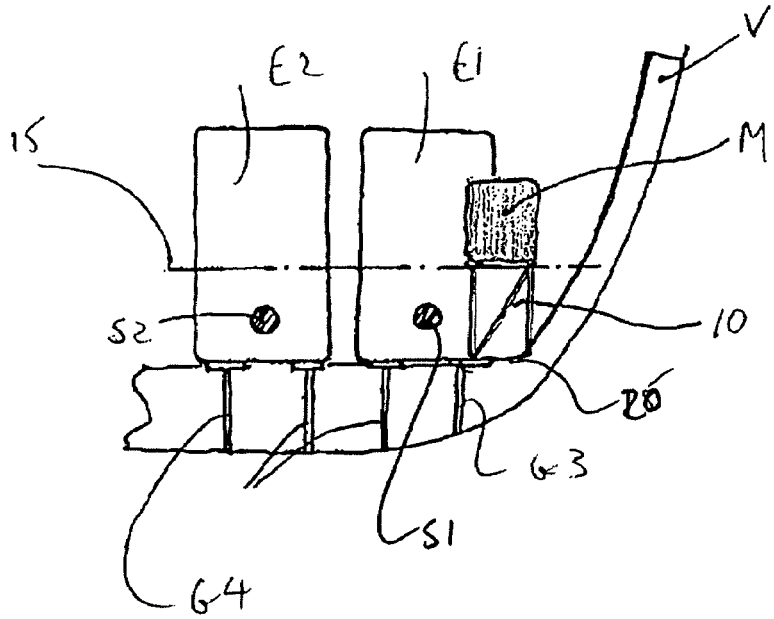
FIG. 3 is a cross sectional view taken through the engine room illustrating the association of the auxiliary machinery with the main engine.
Figure 4:
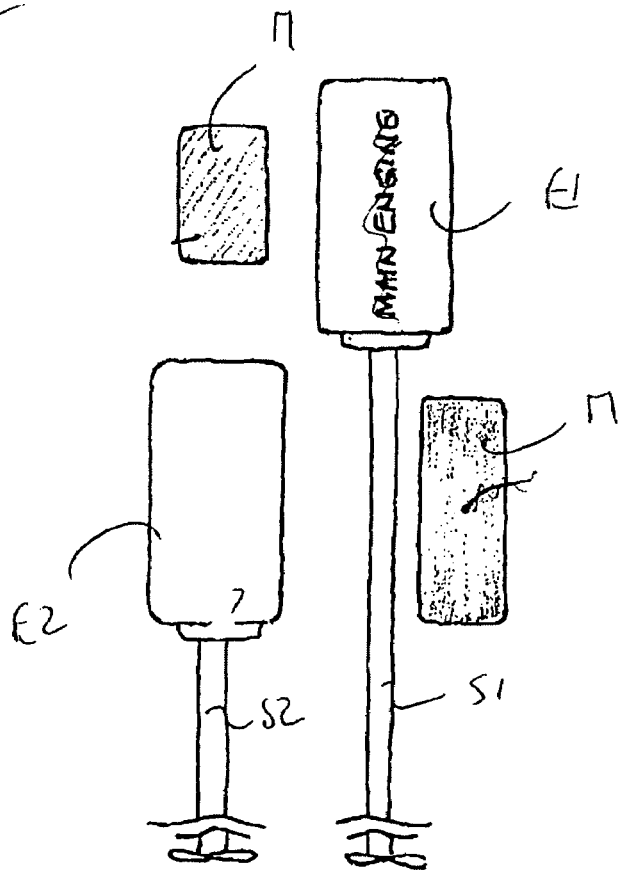
FIG. 4 is a plan view of the engine room.
Figure 5:
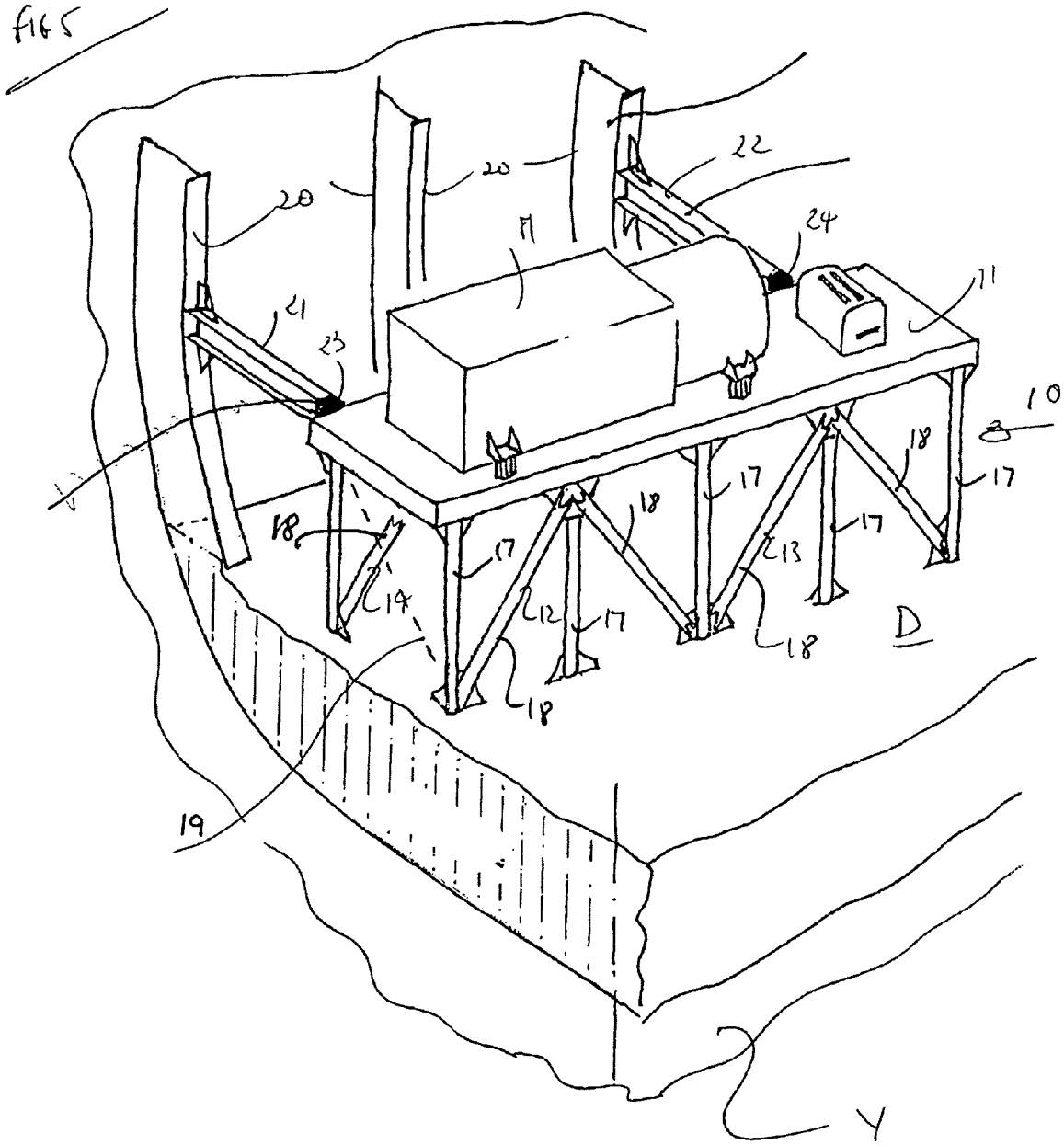
FIG. 5 is a partial perspective view showing the support for auxiliary machinery in association with the frame of the vessel.

In the embodiment shown in FIGS. 2 to 5, a trussed frame 10 is used to support a rectangular horizontal plate 11 which in turn supports the auxiliary machinery M via flexible mounts F mounted at each corner of the machinery. The trussed frame 10 not only provides support for the auxiliary machinery but also acts to elevate the machinery above the level of the main engine E as shown in FIGS. 3 and 4.

The trussed frame 10 comprises elongate aluminum beams that are fastened to one another to define a triangular array with the upper plate 11 and bottom plating (not shown) of the vessel V. As shown in FIG. 3 which is a cross section through the engine room, the main engines E1 and E2 are supported on vertical girders G3 and G4 with the main output shafts S1 and S2 extending rearwardly at a level below the floor plate 15 which is the working level of the vessel. The auxiliary machinery M is supported so that the base of the machine is level with the floor plate 15 and the aluminum trussed frame 10 supports the auxiliary machinery M through connection to the side frame 20 of the vessel V and the girders that support the main engines. As shown in FIG. 4 in plan the auxiliary machinery M is positioned away from the main engines E1 and E2 at a level above the output shafts S1 and S2 thereby providing easy access both to the machines themselves and to the space underneath the machines due to the open structure of the trussed frame 10.

The trussed frame 10 has two triangular frames 12 and 13 along the longer sides and a single triangular frame 14 across the ends. The frames 12 and 13 comprise vertical uprights 18 joined by a diagonal bracing beam 17. A diagonal bracing beam 19 joins the frame at the end of the structure. All the beams are mounted to extend in a vertical plane. The trussed frame can support the plate in a free standing manner or, in the embodiment shown in FIG. 5, the ships side frames 20 are connected to the rectangular support plate 11 via elongate beams 21 and 22 that can be connected to the plate 11 via flexible mounts 23 and 24. The opposite ends of the beams 21, 22 are firmly secured to the side frame 20 of the vessel V. The beams 21 and 22 can be on both or one side of the plate 11. In this embodiment the diagonal beam 19 across the ends of the frame 10 are removed but the sides of the rectangular plate 11 are supported by the triangular trussed frame 10 structure as described above. This drawing also shows how the trussed structure 10 is firmly secured through bolting or welding to the deck D that extends laterally across the sides of the vessel V.

The triangular trussed structure provides ready access underneath the plate 11 and thus allows maintenance and access to the associated service lines that could be electrical cable, water piping or fuel supply lines. It also allows maintenance and access to the main output shaft 51 where this may pass close by The use of trussed frames 10 to support the auxiliary machinery M is particularly desirable in multi hulled vessels that operate at high speed. The auxiliary machinery M can be positioned where it is readily accessible and there is ready access to the underside of the machinery for service purposes. The use of a trussed frame provides the required degree of support and rigidity in a light weight structure that does not substantially obstruct access within the engine room.

The beams that make up the truss structure 10 are either of rectangular of square cross section though it is understood that they could also be of circular or other cross section. It is further understood although, not shown that vibrational dampers can be positioned within the truss elements where they are secured to the floor of the vessel, to each other and the support plate 11. In a preferred embodiment all the structural members are made of aluminum.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A support structure for auxiliary machinery in a seagoing vessel, the support structure comprising a trussed frame, disposed beneath a mounting plate, for supporting the mounting plate at an elevated height above the bottom or deck of the vessel, the mounting plate being adapted to support auxiliary machinery, the trussed frame comprising an open framework comprising a plurality of upright and angled beams arranged in triangles along the sides and ends of the frame, whereby the frame elevates the machinery and provides ready access to the underside of the machinery.

2. The support structure according to claim 1, wherein the beams are constructed in aluminum.

3. The support structure according to claim 1, wherein the beams have a rectangular or square cross section.

4. The support structure according to claim 1, wherein a diagonal bracing beam is removed from either end of the frame to make way for a girder joining the plate or frame to at least one side of the vessel.

5. The support structure according to claim 1, wherein vibration damping mounts are positions between the frame and the plate or at joins between the beams of the truss.

6. A hull for a seagoing vessel comprising an enclosure that houses a propulsion means and auxiliary machinery, the auxiliary machinery being mounted through flexible mounts on a mounting plate that is supported at an elevated height above the base or a deck of the vessel via a trussed frame that is secured to the vessel, said trussed frame being disposed beneath the mounting plate so as to support the mounting plate and comprising an open framework comprising a plurality of upright and angled beams arranged in triangles along the sides and ends of the frame.

* * * * *